United States Patent [19]

Boeni et al.

[11] 4,389,870

[45] Jun. 28, 1983

[54] FORMING ENGAGEMENT GROOVES IN A TOOL SHANK

[75] Inventors: Hans Boeni, Buchs, Switzerland; Beda Meier, Schaanwald; Gabor Szacsvay, Triesen, both of Liechtenstein

[73] Assignee: Hilti Aktiengesellschaft, Schaan, Liechtenstein

[21] Appl. No.: 257,421

[22] Filed: Apr. 23, 1981

[30] Foreign Application Priority Data

Apr. 24, 1980 [DE] Fed. Rep. of Germany ..... 3015893

[51] Int. Cl.[3] ..... B21D 22/00

[52] U.S. Cl. ..... 72/354; 72/358; 72/401

[58] Field of Search ..... 72/354, 358, 359, 401

[56] References Cited

U.S. PATENT DOCUMENTS

| | | | |
|---|---|---|---|
| 2,006,283 | 6/1935 | Staempfle | 72/401 |
| 2,302,115 | 11/1942 | Gazey | 72/354 |
| 3,637,225 | 1/1972 | Schmuck . | |

*Primary Examiner*—Leon Gilden

*Attorney, Agent, or Firm*—Toren, McGeady and Stanger

[57] ABSTRACT

In the formation of engagement grooves in the shank of a tool for use in a hammer drill or chipping hammer, a matrix or die is divided along a junction plane into two matrix halves. A bore for holding the tool to be punched is formed along the junction plane so that the plane divides the bore in half in its axial direction. Guide openings are formed in the opposite sides of the matrix extending into the bore for receiving punching dies. The matrix halves combine to form these guide openings which are located in the junction plane so that the punching pressure is applied in this plane. The closing pressure for holding the matrix halves together is applied at right angles to the junction plane.

1 Claim, 1 Drawing Figure

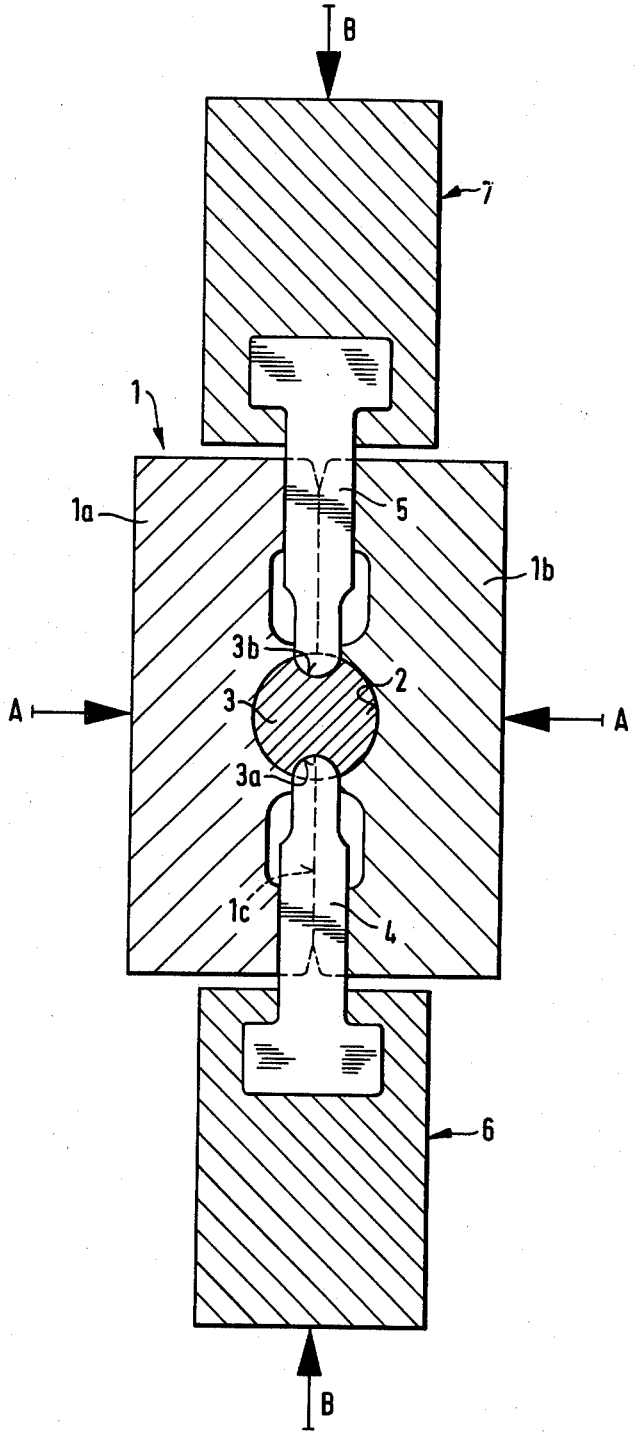
B
7
1
1a
5
1b
3b
2
A
3
A
3a
1c
4
6
B

FORMING ENGAGEMENT GROOVES IN A TOOL SHANK

SUMMARY OF THE INVENTION

The present invention is directed to a method of and device for the formation of engagement grooves in the shank of a tool for use in a hammer drill or a chipping hammer.

All tools used at the present time in hammer drills or chipping hammers are distinguished in that, in addition to the actual working part of the tool, they have a shank end which is inserted into the tool holder or chuck of the hammer drills or chipping hammers. In a tool for use in a hammer drill, for instance, in addition to the cutting bit and borings removal spiral, a shank is provided at the opposite end from the cutting bit for engagement in the tool holder of the drill. The shanks of such tools are of a special construction to afford such engagement so that the tool can be coupled within the tool holder and held against rotation and/or axial displacement relative to the hammer drill or chipping hammer.

In the past, such shanks usually had a polygonal cross-section to achieve the coupling action for securing the tool against rotation. At the present time, however, engagement grooves of a limited axial length are used in the shank. As compared to a polygonal cross-section of the shank, such engagement grooves have the advantage they are suitable for connection for rotation as well as for the axial support of the tool when inserted into the tool holder of a hammer drill or chipping hammer. In shanks having a polygonal cross-section, special features, such as collars or transverse notches, have been necessary, especially for axial support.

While the number of engagement grooves which are used may be selectively adjusted to the conditions of force applied, there are no great possibilities for varying the shape of the grooves in view of the notch effect, weakening of the cross-section and the like. In view of a uniform distribution of force at the shank of these tools, a symmetrical arrangement of the engagement grooves has been successful and at the present time a pair of engagement grooves located opposite each other has a wide spread practical application.

Up to the present time engagement grooves have been produced in a milling operation. In addition to the relatively great amount of time spent in the milling operation, such a procedure has the usual effects of a chip removing process. These effects result, in particular, in the deterioration of the physical properties of the tool. The shank of such a tool must avoid such deterioration, because it is in the shank where the largest forces are transmitted and a reduction in cross-sectional area is unavoidable.

Therefore, it is the primary object of the present invention to provide a method of and device for the formation of engagement grooves in the shank of tools used in hammer drills or chipping hammers which afford not only reliable engagement but also good physical properties for the tool.

In accordance with the present invention, in the formation of the engagement grooves, the shank of the tool is inserted into the bore of a divided matrix and punching dies for forming the grooves are guided toward the tool along the junction plane of the matrix parts.

In accordance with the present invention, a noncutting shaping of the engagement grooves provides a positive effect on the tool, in particular on its physical properties. Applying the punching pressure to the dies along the junction plane of the matrix assures that the matrix is not divided in that region where the greatest forming pressures are developed. Accordingly, undesirable deformations of the shank, such as convex surface portions, ridges and the like, are prevented. The closing pressure for the matrix parts can be applied separately and independently from the application of pressure to the punching dies because of the manner in which the matrix is divided with the punching dies entering the matrix in the junction plane. Consequently, the closing pressure applied to the matrix parts can be provided in an optimum manner corresponding to the forces to be applied to the tool. Therefore, in accordance with the present invention, a high-grade shank for a tool to be used in a hammer drill or a chipping hammer is afforded, particularly with regard to accuracy and tolerances.

The application of the method according to the present invention doesn't depend on the number and shape of the engagement grooves to be formed in the shank of the tool. The shape of the engagement grooves in cross-section may have the form of a circular segment, a trapezoid or the like, with the segment-shaped cross-section in the bottom of the groove extending as a concave surface or as a plane surface. Due to the notch effect, the ends of the engagement grooves preferably extend as concave surfaces toward the outside surface of the shank.

The device for carrying out the method of the present invention is characterized by a divided matrix with punching dies and the application of the punching pressure through the dies being applied in the junction plane of the matrix. Advantageously, the longitudinal axes of the punching dies lies in the junction plane of the matrix. If engagement grooves are to be located symmetrically opposite one another in the shank, then the device may be formed of two symmetrical matrix halves with the punching dies being guided along the junction plane surfaces of the matrix halves. In such an arrangement, the pressure applied to the punching dies is directed at right angles to and independently of the pressure applied to close the matrix halves.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing a section through a schematically illustrated punching device is shown for performing the method of the present invention.

DETAIL DESCRIPTION OF THE INVENTION

In the drawing a die or matrix 1 is made up of matrix halves 1*a*, 1*b*. A junction plane 1*c* defines the separation plane between the two halves 1*a*, 1*b* of the matrix 1. The matrix 1 has a bore 2 extending through its center into which the tool to be punched is inserted. As can be seen in the drawing, the shank of a tool 3 is shown in section. A pair of punching dies 4, 5 are inserted into guide openings formed in the junction plane 1*c* dividing the matrix halves 1*a*, 1*b*. The ends of the punching dies 4, 5 extending outwardly from the matrix are held in a form-locking manner within known punching mounts 6, 7.

The drawing illustrates the method of the present invention at the completion of the punching process. By applying the punching pressure B to each of the mounts 6, 7, the punch dies are formed inwardly into the surface of the shank of the tool 3 and form the engagement grooves 3*a*, 3*b*. To assure that the shank of the tool 3 remains completely round even after the punching operation, the bore 2 has a slightly oval-shaped cross-section with the longer diameter of the oval extending in the direction of the application of the punching pressure via the punching dies 4, 5. With the punching dies 4, 5 being located in the junction plane 1*c* of the matrix 1, it is possible to apply the closing pressure A against the matrix halves 1*a*, 1*b* simultaneously and independently of the application of the punching pressure B. Therefore, the matrix closing pressure A can be adjusted to the highest punching pressure. In addition, the region of the highest forming pressure, which in the arrangement shown in the drawing is approximately perpendicular to the punching pressure provided by punching dies 4, 5, is located in a part of the matrix where there is no separation whereby no undesirable convex surface portions or ridges can develop on the shank of the tool 3.

Further finishing of the shank, which could become necessary under certain circumstances if such disadvantageous surface defects are formed, can be avoided with the method of the present invention.

In the description of the method and the device for carrying out the method two engagement grooves are formed in diametrically opposite sides of the shank, accordingly, the matrix 1 is divided into two halves. If more than two engagement grooves are to be formed, it can be appreciated that the division of the matrix into separate parts would depend on the number of grooves to be punched into the shank of the tool.

While specific embodiments of the invention have been shown and described in detail to illustrate the application of the inventive principles, it will be understood that the invention may be embodied otherwise without departing from such principles.

We claim:

1. Device for the formation of engagement grooves in the shank of a tool for use in a hammer drill or chipping hammer, comprising a matrix having an axially elongated bore therethrough for receiving and holding the solid shank of the tool during the punching operation, said matrix is divided along a single junction plane into completely separate matrix parts each forming a coextensive axially elongated part of the bore with each axially extending bore part opening to the single junction plane and being closed in the angular direction around the axis between the intersection of the junction plane with the bore, said separate matrix parts combining to form punching die guide openings located in the single junction plane and spaced angularly apart about the axis of the matrix bore, and a punching die insertable into each of the punching die guide openings for applying punching pressure to the shank of the tool held in the matrix bore with the punching pressure being applied in the single junction plane between the matrix parts, said matrix being divided into two symmetrically shaped matrix halves and with the single junction plane formed there between dividing the matrix bore into two axially extending symmetrical bore halves, and means for applying closing pressure to said matrix halves for holding the shank of the tool in the matrix bore with the closing pressure being applied perpendicularly to the junction plane located between said matrix halves.

* * * * *